US007434964B1

(12) United States Patent
Zheng et al.

(10) Patent No.: US 7,434,964 B1
(45) Date of Patent: Oct. 14, 2008

(54) LED LAMP WITH A HEAT SINK ASSEMBLY

(75) Inventors: Shi-Song Zheng, Shenzhen (CN); Guang Yu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/776,877

(22) Filed: Jul. 12, 2007

(51) Int. Cl.
*F21V 29/00* (2006.01)

(52) U.S. Cl. ..... 362/294; 362/218; 362/240

(58) Field of Classification Search ..... 362/217, 362/218, 219, 225, 227, 236, 240, 294, 373
See application file for complete search history.

(56) References Cited

U.S. PATENT DOCUMENTS 6,815,724 B2 * 11/2004 Dry ..... 257/88
2007/0230172 A1 * 10/2007 Wang ..... 362/249
2007/0230184 A1 * 10/2007 Shuy ..... 362/294
2007/0230185 A1 * 10/2007 Shuy ..... 362/294
2007/0247851 A1 * 10/2007 Villard ..... 362/294
2007/0279862 A1 * 12/2007 Li ..... 361/692
2008/0007954 A1 * 1/2008 Li ..... 362/294

* cited by examiner

*Primary Examiner*—Hargobind S Sawhney
(74) *Attorney, Agent, or Firm*—Frank R. Niranjan

(57) ABSTRACT

An LED lamp adapted for lighting includes a heat sink (30), a bowl-shaped cover (20) attached to a bottom portion of the heat sink, a lamp seat (10) secured below the cover, a plurality of LEDs (54) mounted on an outside surface of the heat sink, and a plurality of heat pipes (40) contacting with interior face of the heat sink. The heat sink has a plurality of fins (34, 36) extending from sidewalls thereof. The cover has a plurality of apertures (220) defined on lateral wall thereof. The heat generated by the LEDs can be transferred to the heat sink evenly via the heat pipes, and is then dispersed to ambient air efficiently and rapidly.

15 Claims, 4 Drawing Sheets

LED LAMP WITH A HEAT SINK ASSEMBLY

BACKGROUND OF THE INVENTION

1. Field of the Invention

The present invention relates to a light emitting diode (LED) lamp, and more particularly to an LED lamp incorporating heat pipes for improving heat dissipation of the LED lamp.

2. Description of Related Art

LED (light emitting diode) lights are highly energy efficient electrical light sources, and are increasingly being considered for indoor lighting purposes. In order to increase the overall lighting brightness, a plurality of LEDs are often incorporated into a signal lamp, but these can lead to significant problems with over-heating.

Conventionally, an LED lamp comprises a cylindrical enclosure functioning as a heat sink and a plurality of LEDs mounted on an outer wall of the enclosure. The LEDs are arranged in a plurality of lines along a lateral side of the enclosure and around the enclosure. The enclosure is open at one end. When the LEDs are activated, heat generated by the LEDs is dispersed to ambient air via the enclosure by natural air convection.

However, in order to achieve a required lighting intensity, the LEDs are grouped next to each other, which leads to an uneven heat distribution over the enclosure, thus lowering heat dissipation efficiency.

What is needed, therefore, is an LED lamp which can overcome the above-mentioned disadvantages.

SUMMARY OF THE INVENTION

An LED lamp includes a heat sink, a bowl-shaped cover attached to a bottom portion of the heat sink, a lamp seat secured below the cover, a plurality of LEDs mounted on an outside surface of the heat sink, and a plurality of heat pipes contacting with an interior wall of the heat sink. The heat sink has a plurality of fins extending from sidewalls thereof. The cover has a plurality of apertures defined in a lateral wall thereof. Heat generated by the LEDs can be transferred to the heat sink evenly using the heat pipes, and is then dispersed to ambient air efficiently and rapidly.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
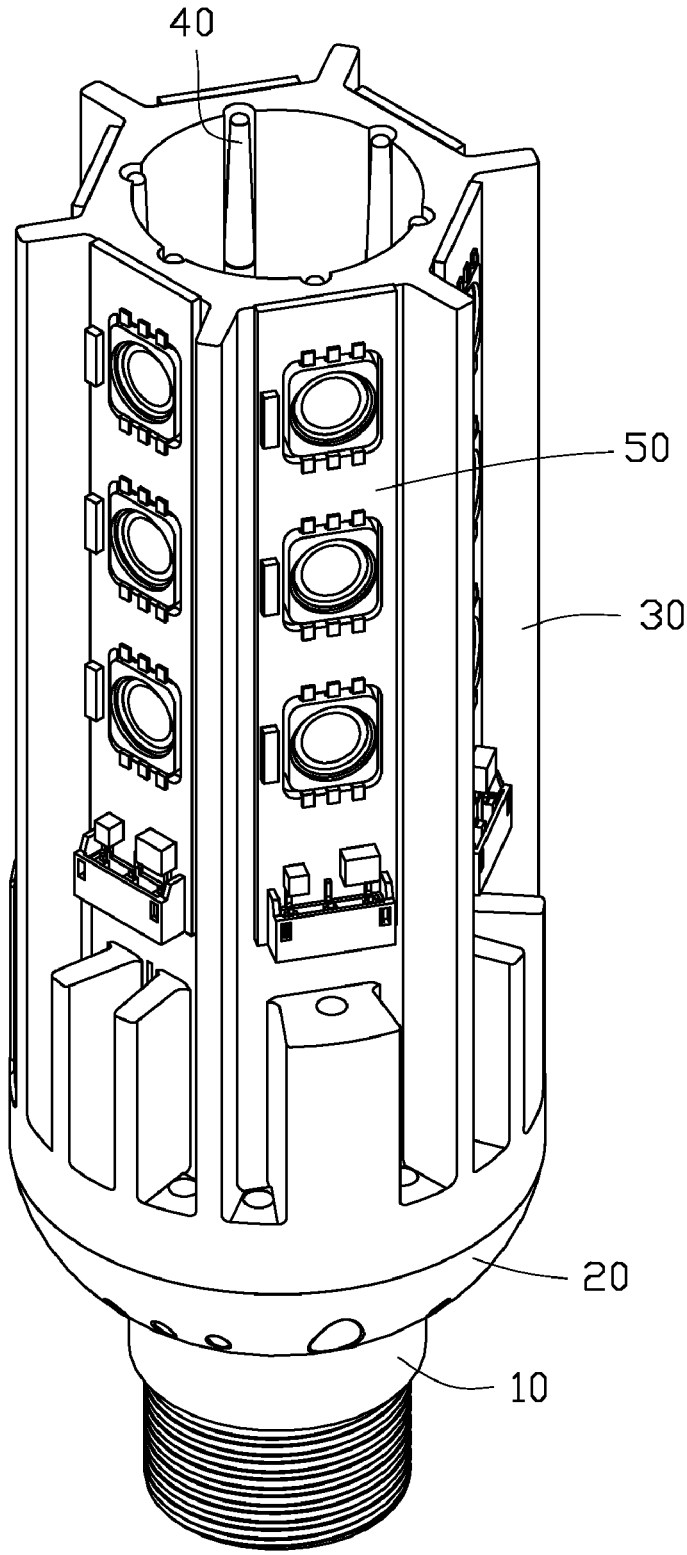
FIG. 1 is an assembled, isometric view of an LED lamp with a heat sink assembly in accordance with a preferred embodiment of the present invention.

Referring to FIG. 1, an LED lamp adapted for a lighting purpose comprises a heat sink 30, a plurality of LED modules 50 mounted on periphery of the heat sink 30, a plurality of heat pipes 40 attached to interior of the heat sink 30, a cover 20 secured to a bottom portion of the heat sink 30, and a lamp seat 10 engaging with the cover 20.

Figure 2:
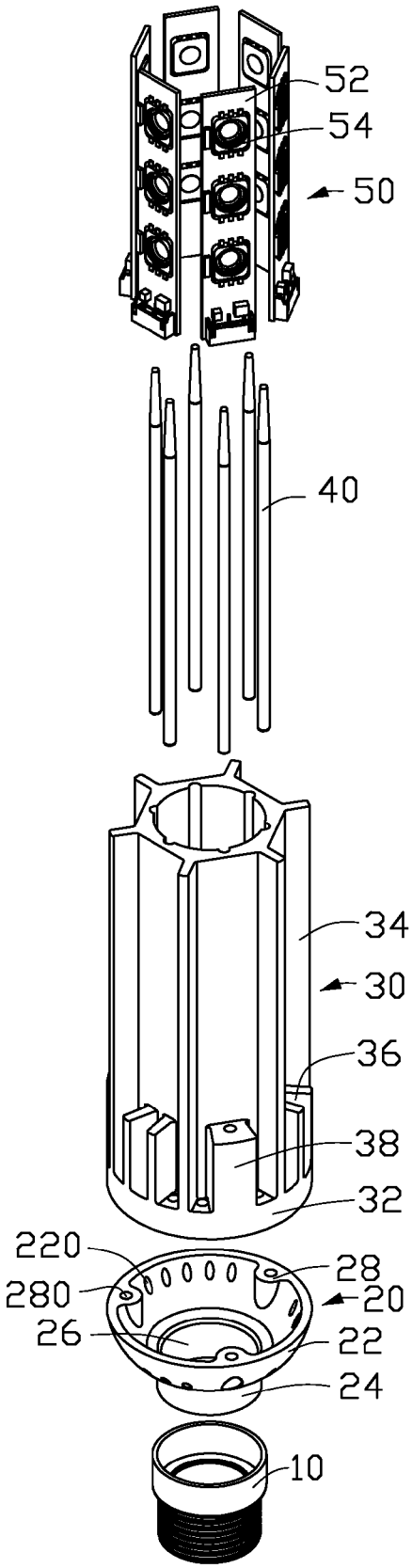
FIG. 2 is an exploded view of FIG. 1.

As shown in FIG. 2, the cover 20 comprises a bowl-shaped body 22. A through hole 26 is defined in a bottom portion of the body 22. An annular wall 24 extends from an edge of the bottom portion of the body 22 for engaging with the lamp seat 10. Three arced bulges 28 project evenly from an inner face at a top portion of the body 22 in a manner such that 120° angles are defined therebetween. Each bulge 28 has a planar top face that is in a common plane with a top face of the body 22. A through hole 280 with a larger bottom portion is defined at the top face of each bulge 28. A plurality of oval apertures 220 is evenly defined in a sidewall of the body 22 and near the top face of the body 22 between the bulges 28 for allowing air flows therethrough. The cover 20 is employed as an electric isolator for interconnecting the heat sink 30 and the lamp seat 10 dielectrically.

Figure 3:
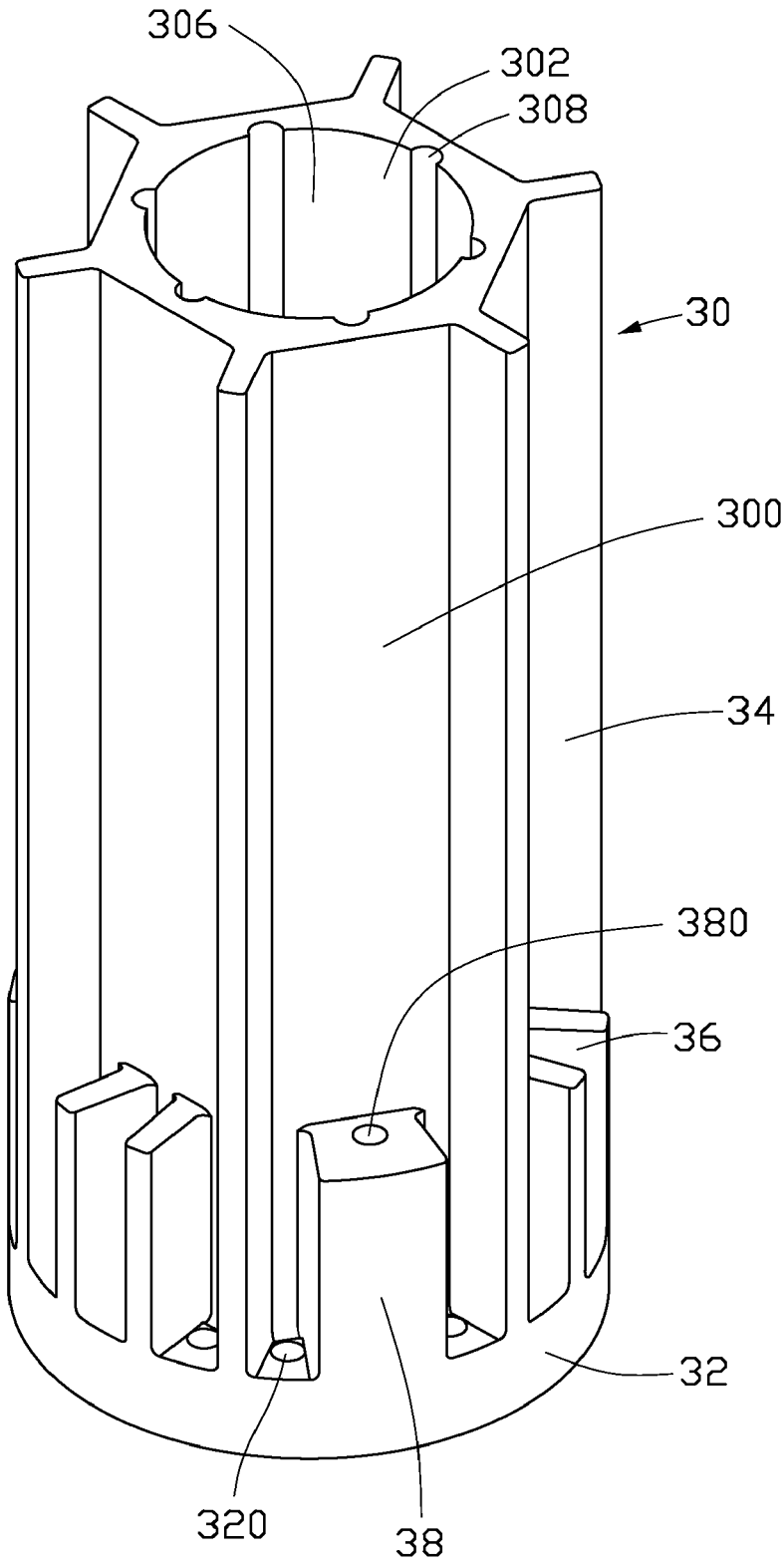
FIG. 3 is an enlarged view of a heat sink of FIG. 2.
Figure 4:
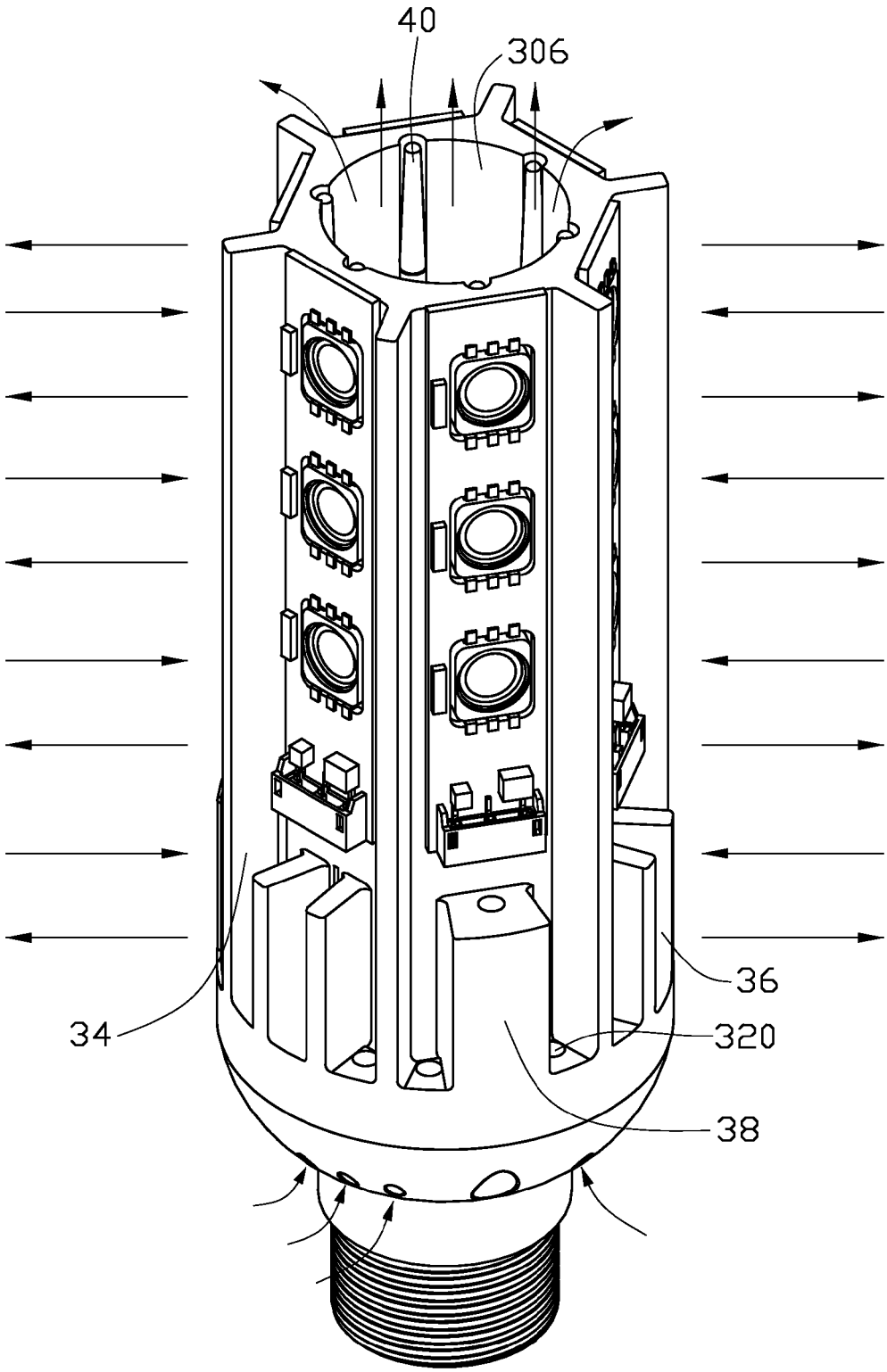
FIG. 4 is a view of an airflow flowing direction of the LED lamp of FIG. 1.

Referring to FIG. 3, the heat sink 30 is made as a single piece from a metal such as aluminum, copper or an alloy of the two. The heat sink 30 comprises a hollow hexagonal prism, which has six rectangular and identical sidewalls 300. The hexagonal prism defines a circular through hole 306 at a center thereof communicating with the through hole 26 of the cover 20, thereby having a cylindrical inner face 302. Six semi-circular grooves 308 are evenly defined on the inner face 302 around and communicating with the through hole 306. Each groove 308 is defined at a position corresponding to a centre of each sidewall 300 and extends along an axis of the hexagonal prism from a top to a bottom of the heat sink 30, for receiving a corresponding heat pipe 40 therein. An annular base 32 extends horizontally and outwardly from the sidewalls 300 at a bottom portion of the heat sink 30. The base 32 has a bottom face contacting with the top face of the cover 20 in an insulated manner. The base 32 forms a plurality of rectangular fins 34 extending perpendicularly and upwardly from a top face thereof at joints of neighboring sidewalls 300 of the heat sink 30 so that the fins 34 are distributed evenly with respect to the heat sink 30 in a radial manner. A top face of each fin 34 is located in a common plane defined by a top face of the heat sink 30. The six sidewalls 300 of the hexagonal prism and the six fins 34 together form six regions. A protrusion 38 respectively projects upwardly and vertically from the top face of the base 32 at each of the three spaced regions, corresponding to the bulges 28 of the cover 20, thus engaging with the bulges 28 threadingly for attaching the heat sink 30 to the cover 20. A pair of spaced fins 36 respectively project upwardly and vertically from the top of the base 32 around the heat sink 30 at each of another three spaced regions. The protrusion 38 and the pair of fins 36 are respectively distributed alternately at adjacent regions. The protrusions 38 and the fins 36 have essentially identical heights which are less than that of the heat sink 30. The protrusions 38 and the fins 34, 36 contact the sidewalls 300 of the heat sink 30 in a manner such that horizontal distances from a centre of the heat sink 30 to outer peripheries of the fins 34, 36 and the protrusions 38 are essentially identical to an outer radius of the base 32. Each protrusion 38 defines a through hole 380 communicating with the hole 280 of corresponding bulge 28 of the cover 20 for providing passage of a screw (not shown) to attach the heat sink 30 to the cover 20. A pair of through holes 320 are defined in flanks of each protrusion 38 and each pair of fins 36 at corresponding regions.

Referring to FIG. 2 again, the heat pipes 40 are straight and accommodated in the grooves 308 of the heat sink 30 parallel to each other.

Each LED module 50 comprises an elongated printed circuit board 52 and a plurality of evenly spaced LEDs 54 mounted on a front side of the printed circuit board 52. The LEDs 54 of each LED module 50 are arranged in a common line along the elongated direction of the printed circuit board 52. Each LED module 50 is mounted in a thermally conductive relationship with each sidewall 300 of the heat sink 30. The LED lamp is thus connected with the cover 20 and the lamp seat 10 in a manner such that each LED module 50 is located between two adjacent fins 34 along the axis of the heat sink 30 and above the protrusions 38 and the fins 36 of the heat sink 30. A pair of wires (not shown) extend from a short edge of each printed circuit board 52 and pass through corresponding holes 320 of the heat sink 30 and the hole 26 of the cover 20 for providing electricity to each LED 54.

As shown in FIGS. 1-4, in use, when the LEDs 54 are activated, heat generated by the LEDs 54 is conducted to an upper portion of the heat sink 30 via the printed circuit board 52. Due to the use of the heat pipes 40, the heat can be distributed over the heat sink 30 evenly and rapidly without heat accumulation, thus allowing cool air contacting the heat sink 30 absorb heat evenly. A part of the heat is dispersed to ambient cool air via the periphery of the heat sink 30 such as the fins 34, 36 and the protrusions 38. Remaining heat is conveyed to the cool air in the heat sink 30 via the inner face 302 of the heat sink 30. The cool air flows upwardly away from the heat sink 30 through the upper portion of the through hole 306 of the heat sink 30. Thus it can be seen that the LED lamp has an improved heat dissipating configuration for preventing the LEDs 54 from overheating.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a hollow prism-shaped heat sink with a through hole defined therein from a top to a bottom thereof;

a cover adapted for engaging with the heat sink having a plurality of apertures defined therein for providing passages for airflow;

a plurality of LED modules being attached to an outer sidewall of the heat sink, each of the LED modules comprising a printed circuit board and a plurality of LEDs mounted thereon, the heat sink forming an annular base extending outwardly beyond the outer sidewall thereof to be located spacedly beneath the LED modules; a plurality of additional fins and protrusions extending from the heat sink with at least two additional fins located between two adjacent fins and at least one protrusion located between other two adjacent fins approximate to the at least two additional fins and a plurality of heat pipes mounted on an inner sidewall of the heat sink corresponding to the LED modules, wherein when the LEDs are activated, heat generated by the LED modules is transferred to the heat sink evenly via the heat pipes.

2. The LED lamp of claim 1, wherein the heat sink has a plurality of outer sidewalls with at least one LED module mounted on each of the sidewalls.

3. The LED lamp of claim 2, wherein the heat sink has a cylindrical interior face thereof and a plurality of grooves defined at the interior face of the heat sink for accommodating the heat pipes therein.

4. The LED lamp of claim 2, wherein the annular base is formed at a bottom portion of the heat sink with a bottom face of the base contacting with the cover, the base defines a through hole communicating with the through hole of the heat sink.

5. The LED lamp of claim 4, wherein a plurality of fins are formed outwardly on the sidewalls of the heat sink in a manner such that the fins are located at corresponding joints of adjacent sidewalls of the heat sink, thus cooperatively forming a plurality of regions with the sidewalls.

6. The LED lamp of claim 5, wherein the fins extend from a top face of the base to a top face of the heat sink with the at least one LED module located at corresponding region.

7. The LED lamp of claim 6, wherein the plurality of spaced additional fins and protrusions extend from the sidewalls of the heat sink radially with bottom portions thereof attached to the top face of the base.

8. The LED lamp of claim 7, wherein the protrusions and the additional fins have heights less than that of the heat sink, the LED modules being located above the protrusions and the additional fins of the heat sink.

9. The LED lamp of claim 7, wherein at least two additional fins are located at one region, and at least one protrusion is located at another region adjacent to the at least two additional fins.

10. The LED lamp of claim 9, wherein a plurality of through holes are defined at the top face of the base and at the regions in such a manner that the holes are defined at flanks of corresponding protrusions and additional fins.

11. The LED lamp of claim 9, wherein the cover has a bowl-shaped configuration, a plurality of bulges are formed at an inner wall of the cover for threadingly engaging with the heat sink.

12. A heat sink assembly for dissipating heat from LED modules, the heat sink assembly comprising:

a hollow heat sink, the heat sink having a plurality of sidewalls adapted for mounting the LED modules thereon, an inner wall defining a plurality of grooves therein;

a plurality of heat pipes being accommodated in corresponding grooves adapted for transferring heat generated by the LED modules to the heat sink evenly;

a plurality of fins extending from the heat sink, at least one fin being located at a junction of two adjacent sidewalls of the heat sink for enhancing heat dissipating area of the heat sink; and a plurality of additional fins and protrusions extending from the heat sink with at least two additional fins located between two adjacent fins and at least one protrusion located between other two adjacent fins approximate to the at least two additional fins.

13. The heat sink assembly of claim 12, wherein an annular base is formed at a bottom portion of the heat sink with a hole defined through the base and the heat sink, the base has a bottom face adapted for engaging with a lamp cover to cooperatively construct an LED lamp together with a lamp seat secured to a bottom of the lamp cover.

14. The heat sink assembly of claim 13, wherein the fins, the additional fins and the protrusions extend from a top face of the base of the heat sink in a manner such that the additional fins and the protrusions have heights less than that of the fins of the heat sink.

15. The heat sink assembly of claim 13, wherein a plurality of through holes are defined around the heat sink in the top face of the base with at least two holes located between two adjacent fins, at least one hole located between the additional fin and the adjacent fin, at least another hole located between the protrusion and the adjacent fin.

* * * * *